United States Patent [19]

Block

[11] Patent Number: 4,637,170

[45] Date of Patent: Jan. 20, 1987

[54] ABRASIVE APPARATUS

[76] Inventor: Aleck Block, 800 Warner Ave., Los Angeles, Calif. 90024

[21] Appl. No.: 692,234

[22] Filed: Jan. 17, 1985

[51] Int. Cl.[4] ..... B24B 41/04

[52] U.S. Cl. ..... 51/168; 51/378; 83/666

[58] Field of Search ..... 51/168, 378; 83/666, 83/698, 481; 409/231, 232, 234

[56] References Cited

U.S. PATENT DOCUMENTS

| | | | |
|---|---|---|---|
| 507,223 | 10/1893 | Hyde | 51/168 |
| 566,883 | 9/1896 | Alden et al. | 51/168 |
| 2,417,680 | 3/1947 | Decker | 51/378 |
| 2,726,493 | 12/1955 | Young et al. | 51/168 |
| 3,596,415 | 8/1971 | Donahue | 51/378 |
| 3,808,753 | 5/1974 | Maran | 51/378 |
| 3,844,072 | 10/1974 | Haigh et al. | 51/378 |
| 4,354,328 | 10/1982 | Ainoura | 51/168 |
| 4,439,953 | 4/1984 | Block et al. | 51/378 |

*Primary Examiner*—Roscoe V. Parker

*Attorney, Agent, or Firm*—Ellsworth R. Roston; Charles H. Schwartz

[57] ABSTRACT

A camming member is disposed on a threaded arbor and is provided with a first face having at least one inclined surface. A first face of a reinforcing plate is disposed in abutting relationship to the first face of the camming member and is provided with at least one inclined surface corresponding to the at least one inclined surface of the camming member. A second face of the reinforcing plate abuts a first face of an abrasive disc or wheel. At least one of the second face of the reinforcing plate and the first face of the disc may be constructed to provide a yieldably clutching relationship with the other one of such faces. An internally threaded nut is disposed in a central bore in the disc in abutting relationship to the walls of the bore and to the second face of the disc and is attached to these surfaces as by an adhesive material. The adhesive material may be elastomeric. Abrasive particles are dispersed throughout the disc. When the abrasive disc is disposed on the arbor in abutting relationship with the reinforcing plate and the arbor is rotated and the disc is applied against a workpiece, the at least one inclined surface on the reinforcing plate become cammed on the at least one inclined surface of the camming member. This causes the reinforcing plate to move axially in a direction to provide an enhanced coupling with the abrasive disc.

43 Claims, 9 Drawing Figures

FIG. 5
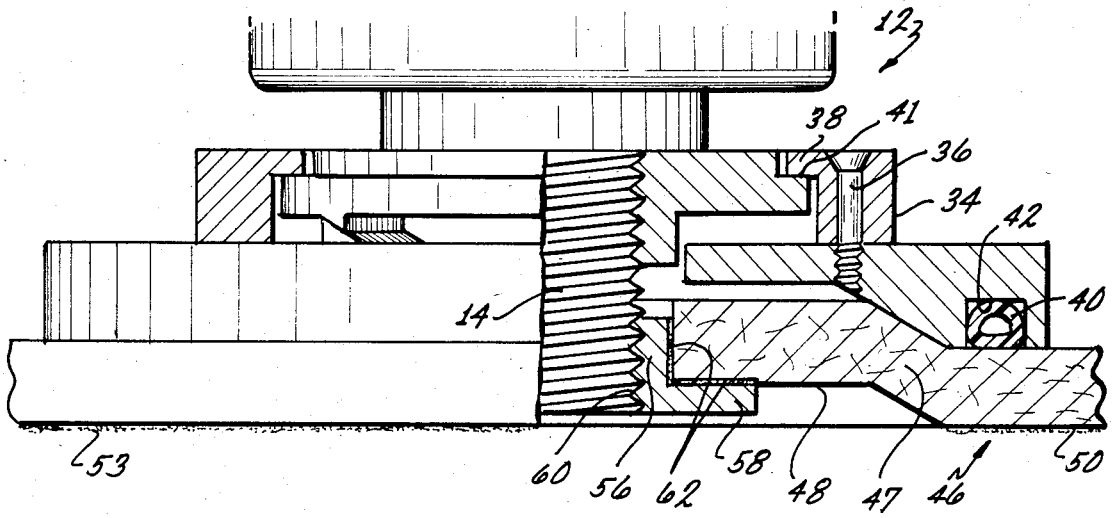
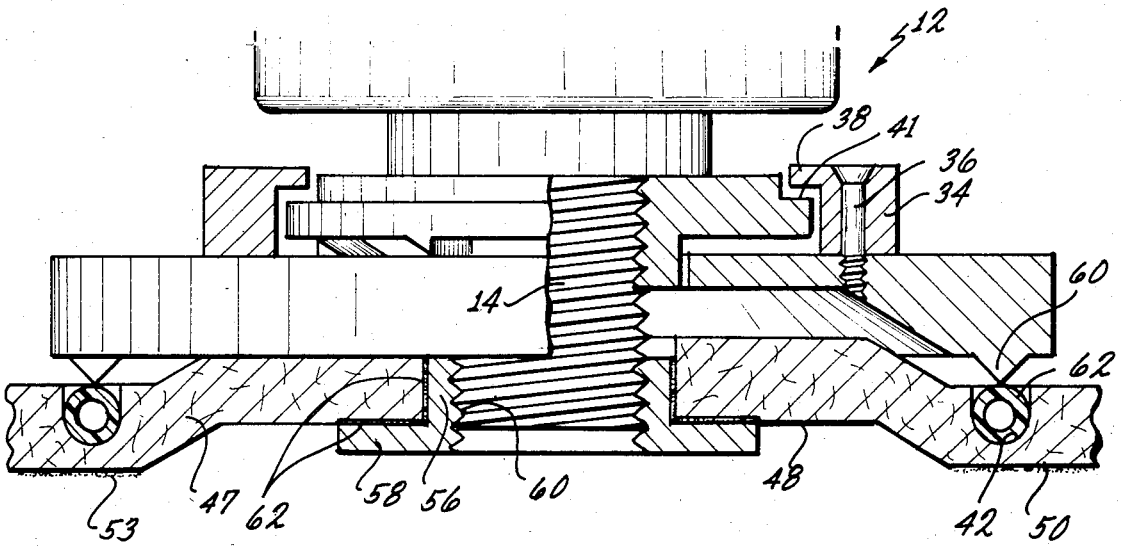
FIG. 6

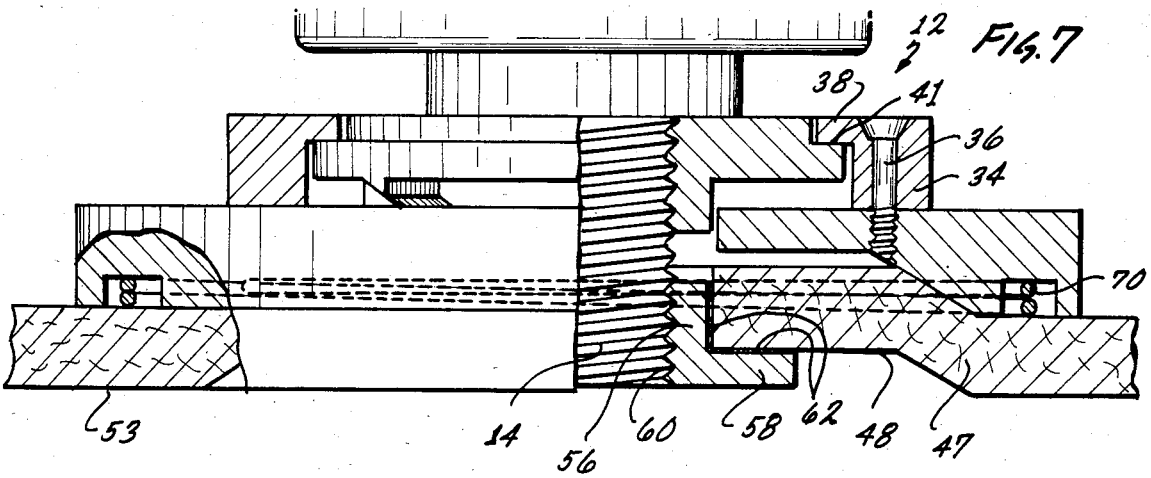
FIG. 7
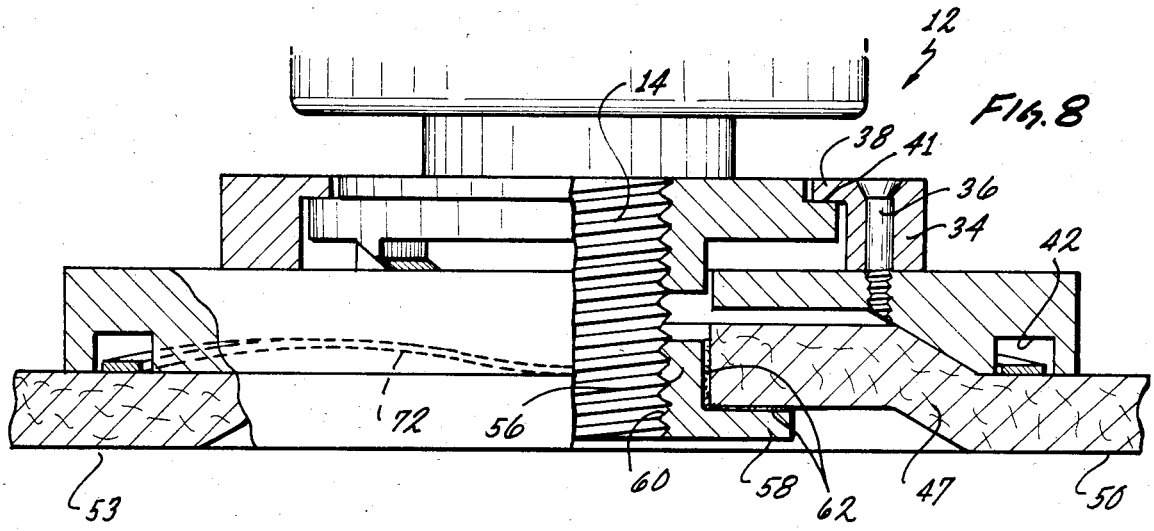
FIG. 8
FIG. 9
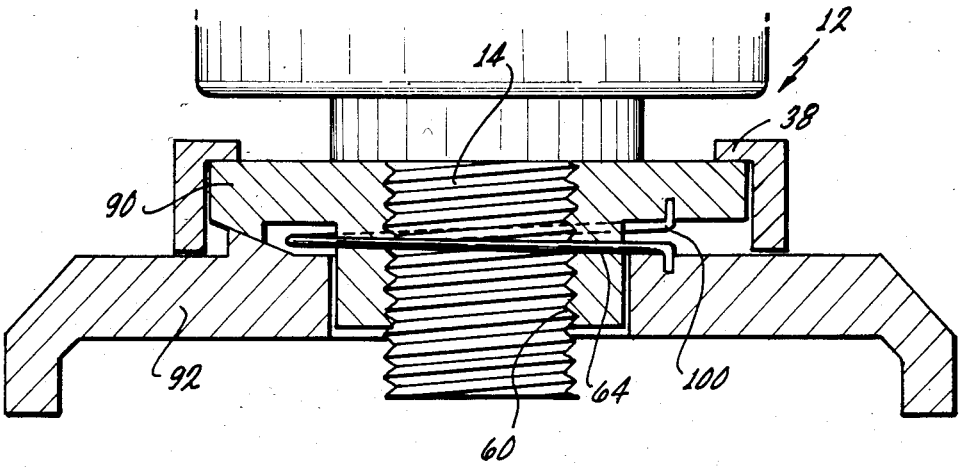

ABRASIVE APPARATUS

This invention relates to abrasive apparatus and more particularly relates to abrasive apparatus in which an abrasive article such as a disc or a wheel can be easily and quickly coupled to the abrasive apparatus and can be easily and quickly removed from the abrasive apparatus.

Abrasive apparatus is used to remove material from a workpiece so as to provide desired dimensions in a workpiece. Abrasive apparatus is also used to polish and smooth surfaces of the workpiece. One type of apparatus employs a support plate which rotates an abrasive disc or wheel. The apparatus includes an arbor and an internally threaded nut which is screwed on the arbor to hold the disc or wheel in fixed position on the arbor. When the disc or wheel is screwed on the arbor, the disc or wheel is applied against the workpiece to abrade, polish or smooth a surface of the workpiece.

During the time that the abrasive disc or wheel is being rotated and being applied against the workpiece, the force of the workpiece against the disc causes the disc to be tightened against the support plate. The tightening of the disc or wheel against the support plate is sometimes so great that the disc or wheel cannot be easily removed from the support plate, even when a great force is applied to the disc to loosen the disc from the support plate. Since disc wear relatively quickly, an inability to remove a worn disc from the support plate is aggravating and time consuming and is inefficient from a cost standpoint. Furthermore, the nut holding the disc on the arbor often becomes loose or misplaced when the disc is removed from the arbor.

A considerable amount of time, and a substantial investment of money, have been expended in attempting to solve the problems specified in the previous paragraph. In spite of such efforts, such problems still persist. Abrasive discs still cannot be easily released from a support plate after they have been operated against the workpiece.

Copending application Ser. No. 692,235 filed by me on Jan. 17, 1985, for an Abrasive Apparatus discloses and claims a reinforcing plate and an abrasive disc which substantially eliminate the problems specified above. The reinforcing plate and the abrasive disc of copending application Ser. No. 692,235 provide a relatively quick and easy release of the disc from the reinforcing plate when a force is applied to the disc to rotate the disc in the release direction after the disc has become closely coupled to the reinforcing plate during operation against a workpiece.

This invention provides apparatus which constitute improvements over the assembly including the disc and reinforcing plate of copending application Ser. No. 692,235. In this way, the apparatus of this invention provides a quick and easy release of the disc from the reinforcing plate when a force is applied to the disc to rotate the disc in the release direction after the disc has been applied against the workpiece during operation. This release force is even less than the relatively small force required to release the disc from the reinforcing plate of copending application Ser. No. 692,235.

In one embodiment of the invention, a camming member is disposed on a threaded arbor and is provided with a first face, preferably flat, but having at least one inclined surface. The at least one inclined surface on the camming member has a relatively shallow angle relative to the flat face of the camming member. A first face of a reinforcing plate is disposed in abutting relationship with the first face of the camming member and is provided with at least one inclined surface corresponding to the at least one inclined surface of the camming member.

A second face of the reinforcing plate abuts a first face of an abrasive disc or wheel. Means may be associated with at least one of the second face of the reinforcing plate and the first face of the disc or wheel to provide a yieldably clutching relationship with the other one of such faces. An internally threaded nut is disposed in a central bore in the disc in abutting relationship to the walls of the bore and to the second face of the disc and is attached to these surfaces as by an adhesive material. The adhesive may be elastomeric. Abrasive particles are adhered to the second face of the backing member.

When the abrasive disc is disposed on the arbor in abutting relationship with the reinforcing plate and the arbor is rotated and the disc is applied against a workpiece, the inclined surfaces on the reinforcing plate become cammed on the inclined surfaces of the camming member. This causes the reinforcing plate to move axially from the camming member in a direction to provide an enhanced coupling with the abrasive disc.

Because of the camming relationship between the inclined surfaces on the camming member and the reinforcing plate, the disc can be easily removed from the reinforcing plate. This results from the fact that the rotation of the disc in the direction for uncoupling the disc from the reinforcing plate causes the cams on the camming member and the reinforcing plate to slide relative to each other in a direction for uncoupling the cams, thereby moving the reinforcing plate toward the camming member and away from the disc.

The adhesive material holding the nut on the disc may be elastomeric to eliminate binding if the arbor is bent. The elastomeric adhesive permits the nut to tip in a compensating manner relative to the arbor and thereby exert relatively even pressure against the disc face. Instead of providing a clutching relationship on adjacent faces of the reinforcing plate and the disc as discussed above, a spring may be attached at its opposite ends to the camming member and the reinforcing plate.

In the drawings:

FIG. 5 is a sectional view similar to that shown in FIGS. 2, 3 and 4 and shows the relationship of the holder and the disc in even more closely coupled relationship than in the previous Figures after the disc has been applied against the workpiece;

FIG. 6 is a sectional view similar to that shown in FIG. 2 and illustrates another embodiment of the invention;

FIG. 7 is a sectional view similar to that shown in FIG. 5 and illustrates a further embodiment of the invention;

FIG. 8 is a sectional view similar to that shown in FIG. 5 and illustrates a still further embodiment of the invention; and FIG. 9 is a sectional view of another embodiment of the invention.

Figure 1:
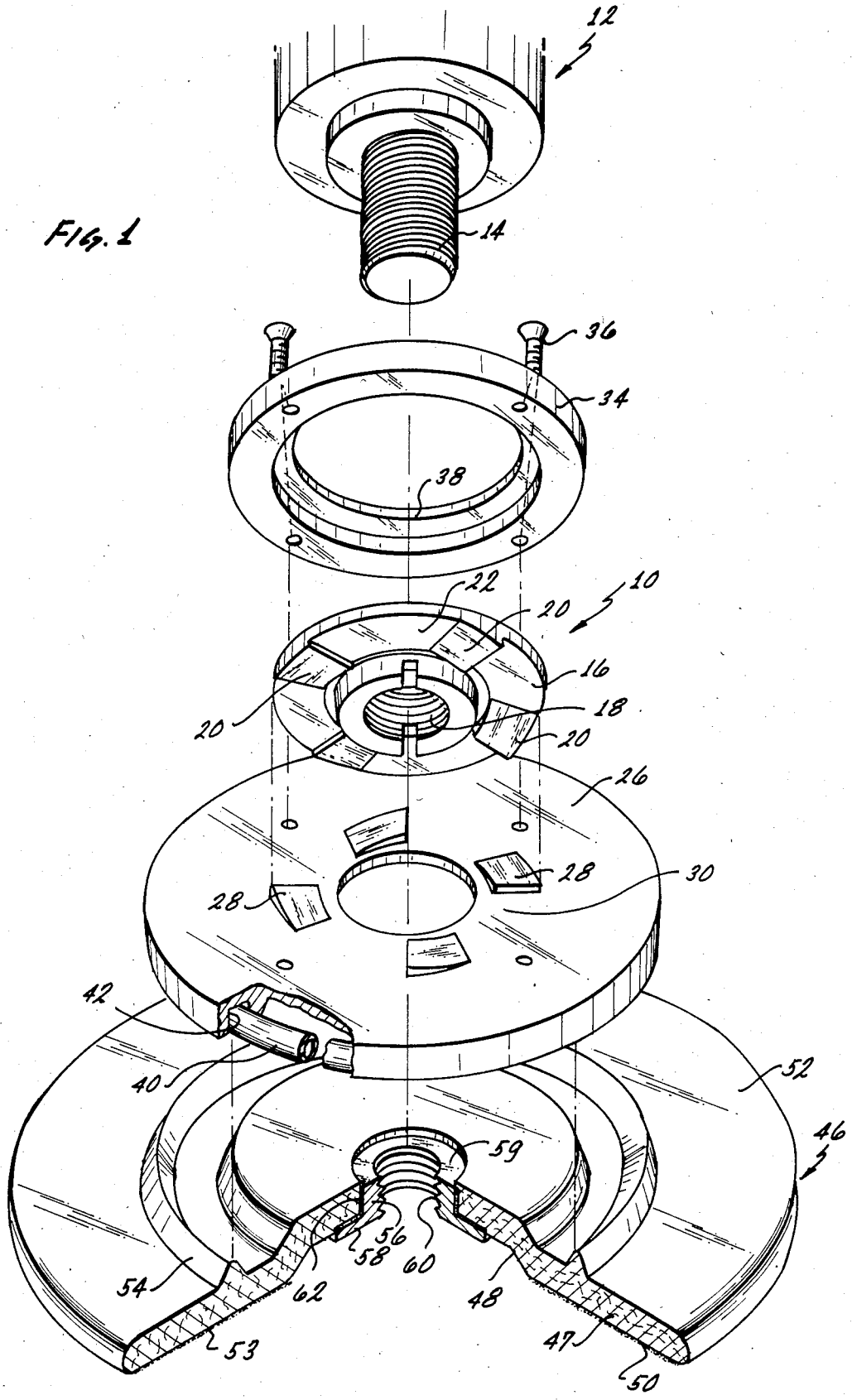
FIG. 1 is an exploded perspective view of a holder and an abrasive disc or wheel included in one embodiment of the invention.

In one embodiment of the invention, an abrasive article generally indicated at 10 includes a holder generally indicated at 12. The holder 12 includes a threaded arbor 14 on which is threaded a camming member 16 having an internally threaded bore 18. The camming member 16 is provided with a plurality of inclined surfaces 20. The inclined surfaces 20 are preferably separated by flat surfaces 22. When four inclined surfaces 20 are provided on the camming member 16, each of the flat surfaces 22 may have an angular length such as approximately seventy-five degrees (75°) and the inclined surfaces 20 may have an angular length such as approximately fifteen degrees (15°).

The inclined surfaces 20 and the flat surfaces 22 are preferably smooth and uniform. The inclined surfaces 20 form a relatively shallow angle with the flat surfaces 22. This angle may be between approximately three degrees (3°) and nine degrees (9°) and is preferably about five degrees (5°). Although a plurality of inclined surfaces are preferred, it will be appreciated that only one inclined surface has to be used.

A reinforcing plate 26 is disposed in abutting relationship with the camming member 16. The reinforcing plate 26 is provided on one face with inclined surfaces 28 and flat surfaces 30 corresponding substantially to the inclined surfaces 29 and the flat surfaces 22 on the camming member 16. The inclined surfaces 28 and the flat surfaces 30 are preferably smooth and uniform. Only one inclined surface 28 has to be used. The yieldable clutching member 40 may be disposed in a pocket 42 in the reinforcing plate 26 on the opposite surface of the reinforcing plate 26 from the inclined surfaces 28.

A detent member 34 may be suitably attached to the reinforcing plate 26 as by bolts 36. The detent member 34 includes a flange 38 which overhangs a shoulder 41 (FIG. 2) on the camming member 16. The detent member 34 prevents the reinforcing plate 26 from being removed from the arbor 12 without simultaneously removing the camming member 16 from the arbor.

A disc generally indicated at 46 is operatively associated with the reinforcing plate 26. The disc 46 may be made from a stiff material such as a phenolic resin. Abrasive particles 47 made from a suitable material such as silicon carbide are dispersed in the phenolic resin. The disc 46 may be formed in the cold state and may then be heated and depressed at the center as at 48. The disc 46 is provided with first and second spaced but parallel surfaces 50 and 52. A suitable projection 54 may be annularly provided on the surface 52 at a position corresponding to that of the yieldable member 40 on the reinforcing plate 26. In the embodiment shown and described above, the disc 46 may be considered as a grinding wheel.

The disc 46 is provided with a central bore 56 and a nut 58 internally threaded as at 60 is disposed in the bore 56. The nut 58 abuts the bore 56 and has a flange abutting the surface 50 adjacent the bore 56 and is suitably adhered to these surfaces. The nut 58 has a barrel portion 59 which preferably has a length less than the thickness of the disc 46 so that it does not extend beyond the surface 52 on the disc 46. The internal threads on the nut 58 are compatible with the threads on the arbor 14.

The nut 58 is suitably adhered to the walls of the bore 56 and to the surface 50 as by an adhesive 62 preferably having elastomeric properties. A silicone material supplied by General Electric is satisfactory as the adhesive 62. The adherence of the nut 58 to the disc 46 as by the elastomeric adhesive 62 is desirable to eliminate binding of the arbor 14 if the arbor should be bent. Under such circumstances, the adhesive 62 permits the nut 58 to tip in a compensating manner relative to the arbor and thereby exert relatively even pressure against the face of the disc 46.

Figure 2:
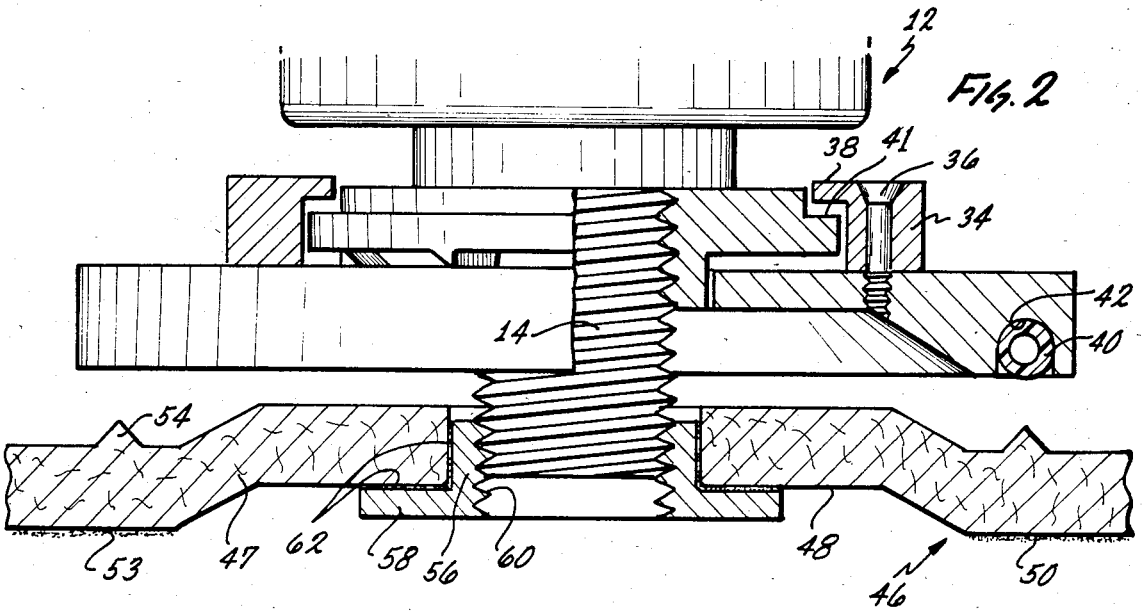
FIG. 2 is a sectional view in partially assembled relationship of the holder and the abrasive disc of FIG. 1.
Figure 3:
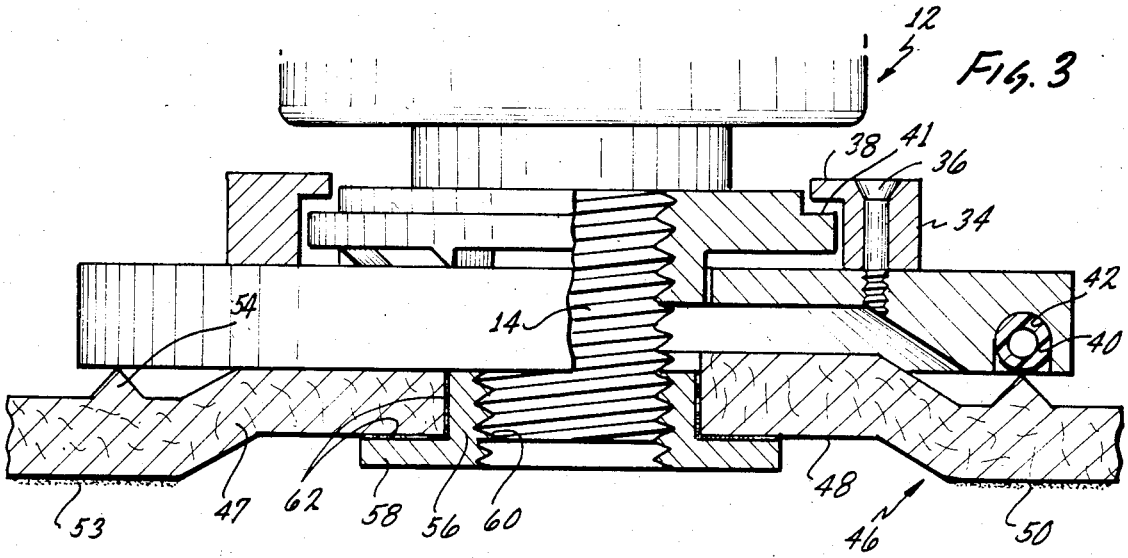
FIG. 3 is a sectional view similar to that shown in FIG. 2 but showing the holder and the disc in an advanced stage of assembly relative to that shown in FIG. 2.

FIG. 2 illustrates the disposition of the disc 46 on the arbor 14 before the disc contacts the reinforcing plate 26. As the disc 46 continues to move in a first direction (upwardly in FIG. 2) along the arbor 14, it engages the reinforcing plate 26 as shown in FIG. 3. This engagement occurs between the projection 54 on the disc 46 and the yieldable member 40 on the reinforcing plate 26. The relationship shown in FIG. 3 occurs when the disc 46 is manually rotated on the arbor 14 to the position engaging the reinforcing plate 26.

The apparatus shown in FIGS. 1 through 3 is ready to be applied to a workpiece (not shown) when the reinforcing plate 26 and the abrasive disc 46 have the relative positions shown in FIG. 3. The force exerted by the workpiece against the disc 46 during the rotation of the disc and during the application of the disc against the workpiece causes the disc 46 and the reinforcing plate 26 to rotate relative to the camming member 16 until the inclined surfaces 28 on the reinforcing plate reach the inclined surfaces 20 on the camming member 16.

Continued rotation of the disc 46 and the reinforcing plate 26 relative to the camming member 16 causes the inclined surfaces 28 on the reinforcing plate 26 to ascend the inclined surfaces 20 on the camming member 16 until this movement is stopped by the friction between the projection 54 and the yieldable member 40 and between the reinforcing plate 26 and the disc 46. This relative movement between the inclined surfaces 20 and 28 results in a displacement of the reinforcing plate 26 axially away from the camming member 16 and axially toward the disc 46 such that the reinforcing plate 26 and the disc 46 become closely coupled as shown in FIG. 5.

As previously described, the inclined surfaces 20 and 28 respectively on the camming member 16 and the reinforcing plate 46 are inclined at angles between 3° and 9° and preferably at an angle of approximately 5°. This inclination allows the inclined surface 28 on the reinforcing plate 26 to move upwardly on the inclined surface 20 of the camming member 16 without binding. Furthermore, it allows the disc 46 to become coupled to the reinforcing plate 26 without having to impose excessive forces on the disc 46.

When the disc 46 becomes worn, it may be desired to replace the worn disc with a fresh unit. To do so, a force is applied to the worn disc 46 on the arbor 14 to move the disc away from the reinforcing plate 26. This movement to disassociate the disc 46 from the arbor 14 is facilitated by the cooperative movement of the reinforcing plate 26 in a direction toward the camming member 16. These movements are the reverse of those discussed above. As a result, it is considerably easier to uncouple the disc 46 from the reinforcing plate 16 than to remove the discs from the arbors of the prior art.

It will be appreciated that the positions of the projections 54 and the yieldable clutching members 40 can be reversed. In other words, a projection 60 can be provided on a reinforcing plate 66 and a yieldable member 62 can be provided on a disc, generally indicated at 66, as shown in FIG. 6. The yieldable clutching member 40 can also be replaced as by a spring 70 (FIG. 7), such as a helical spring, which can be provided with more than one turn. An undulating spring 72 (FIG. 8) can also be used.

In the embodiment of the invention shown in FIG. 9, a camming member 90 and a reinforcing plate 92 are provided in a manner similar to that described above. A coiled spring 100 is attached at one end to the camming member 90 and at the other end to the reinforcing plate 92. The coiled spring 100 is disposed in its unconstrained relationship as shown in FIG. 9.

Figure 4:
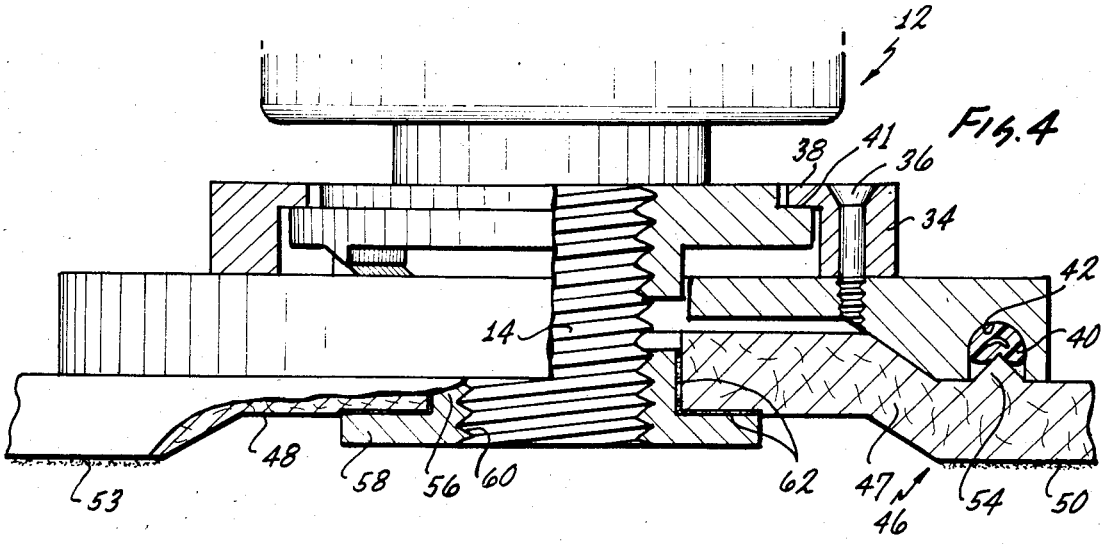
FIG. 4 is a sectional view similar to that shown in FIGS. 2 and 3 but showing the holder and the abrasive disc in an assembled relationship.

During the time that the disc 46 is being moved into the position shown in FIG. 2 relative to the reinforcing plate 92, the coiled spring 100 is maintained in its unconstructed relationship as shown in FIG. 9. As the disc 46 is moved to progressive positions such as shown in FIGS. 3, 4 and 5, the inclined surfaces (corresponding to the inclined surfaces 28) on the reinforcing plate 92 move along the inclined surfaces (corresponding to the inclined surfaces 20) on the camming member 90. This causes the reinforcing member 92 to become separated from the camming member 90 and the spring 100 to become constrained in accordance with such separation. At the same time, a firmly gripping relationship is established between the contiguous surfaces of the reinforcing plate 92 and the disc 46.

When it is desired to remove the disc 46 from the arbor 14, the disc is rotated in an opposite direction from the described in the previous paragraph. Initially, the force exerted on the disc 46 to uncouple the disc from the reinforcing plate 92 in FIG. 9 may have to be slightly greater than the force required to uncouple the disc from the reinforcing plate in the previous embodiments. This results from the constraint imposed upon the spring 100 when the disc 46 and the reinforcing plate 92 are in coupled relationship. However, after an initial force has been applied to the disc 46 to uncouple the disc from the reinforcing plate 92, the forces required to remove the disc from the arbor 14 are substantially the same as in the previous embodiments. Furthermore, the spring 100 operates to return the disc 46 to the position shown in FIG. 2 when the disc has become sufficiently uncoupled from the reinforcing plate 92.

By including the spring 100 in attached relationship to the camming member 90 and the reinforcing plate 90, the yieldable clutching member 40 on the reinforcing plate and the projection 54 on the disc 46 may be eliminated. This results from the fact that the the clutching member 40 and the projection 54 may be considered to perform the same function as the spring 100. For example, the spring 100 in one case (and the yieldable member 54 and the projection 40 in the other case) allows the reinforcing plate 92 to move away from the camming member 90 as the disc becomes tightly coupled to the reinforcing plate and it allows the reinforcing plate 92 to move toward the camming member 90 as the disc 46 is uncoupled from the reinforcing plate 92.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. In combination for use with an abrasive disc having first and second spaced and parallel faces and including abrasive particles on the first face to act upon a workpiece, a threaded arbor, a camming member disposed on the arbor and having an internally threaded bore and having a first face and having at least one inclined surface on the first face, and a reinforcing plate having an internal bore and disposed on the arbor and having a first face disposed in cooperative relationship with the first face on the camming member and having on the first face at least one inclined surface cooperative with the inclined surface of the camming member for variable positioning axially along the arbor in accordance with the relative dispositions of the inclined surfaces on the camming member and the reinforcing plate, the reinforcing plate being disposed on the arbor and having a second surface displaced from the first surface for a clutching relationship with the second face of the abrasive disc and for a positive engagement between the abrasive disc and the reinforcing plate upon the variable positioning of the inclined surface of the first face of the reinforcing plate relative to the inclined surface on the first face of the camming member.

2. A combination as set forth in claim 1 wherein a plurality of inclined surfaces are provided in spaced relationship on the first face of the camming member and a plurality of inclined surfaces are provided in spaced relationship on the first face of the reinforcing plate for cooperative relationship with the first face of the camming member.

3. A combination as recited in claim 1 wherein detent means are disposed on at least one of the second face of the reinforcing plate and the second surface of the abrasive disc for engaging the other one of such second surfaces to provide for a movement of the abrasive disc with the reinforcing plate.

4. A combination as set forth in claim 1 wherein the inclined surfaces on the first face of the camming member are spaced on the first face of the camming member and are separated by flat surfaces on the first face of the camming member and the inclined surfaces on the first face of the reinforcing plate are spaced on the first face of the camming member and are separated by flat surfaces on the first face of the camming member.

5. A combination as set forth in claim 4 wherein the inclined surfaces on the first face of the camming member have a particular angle between approximately three degrees (3°) and nine degrees (9°) relative to the flat surfaces on the first face of the camming member and the inclined surfaces on the first face of the reinforcing plate have the particular angle relative to the flat surfaces on the first face of the camming member.

6. A combination as set forth in claim 1 wherein a spring is attached at its opposite ends to the adjacent surfaces of the camming member and the reinforcing plate.

7. A combination as set forth in claim 1 wherein means are provided on the camming member and the reinforcing plate for limiting the movement of the reinforcing plate relative to the camming member.

8. A combination as set forth in claim 1 wherein the abrasive disc is included in the combination and the reinforcing plate is provided with a yieldable clutching member on its second face and the abrasive disc is provided with means on its second face for engaging the yieldable clutching member on the reinforcing plate.

9. A combination as set forth in claim 4 wherein the abrasive disc is included in the combination and the reinforcing plate is provided with a yieldable clutching member on its second face and the abrasive disc is provided with a projection on the second face to engage the yieldable clutching member on the reinforcing plate.

10. A combination as set forth in claim 9 wherein the disc is provided with a central bore and a nut is disposed in the bore and is attached to the disc by an elastomeric adhesive and the nut is threaded to screw on the arbor.

11. In combination for use with an abrasive disc having first and second spaced faces and including abrasive particles on the first face to act upon a workpiece, an arbor, a camming member disposed on the arbor and having a first face, and a reinforcing plate having first and second opposite faces, the first face of the reinforcing plate being disposed in abutting relationship to the first face of the camming member and the second face of the reinforcing plate being disposed to abut the second face of the abrasive disc when the abrasive disc is screwed on the arbor, the first faces of the camming member and the reinforcing plate being shaped to move the reinforcing plate toward the abrasive disc with rotation of the reinforcing plate relative to the camming member to enhance the coupling between the reinforcing plate and the abrasive disc.

12. A combination as set forth in claim 11, including, means disposed on the camming member and the reinforcing plate for limiting the movement of the reinforcing plate in the direction of the abrasive disc.

13. A combination as set forth in claim 12, including, at least one inclined surface on the first faces of the camming member and the reinforcing plate and disposed relative to each other to provide for a sliding movement of the at least one inclined surface on the reinforcing plate on the at least one inclined surface of the camming member with rotation of the reinforcing plate relative to the camming member to advance the coupling between the reinforcing plate and the abrasive disc.

14. A combination as set forth in claim 11 wherein spring means are associated with the camming member and the reinforcing plate to provide for a movement of the reinforcing plate toward the camming member as the disc becomes decoupled from the reinforcing plate.

15. A combination as set forth in claim 12 wherein the inclined surfaces on the first faces of the camming member and the reinforcing plate as separated by flat surfaces on such first faces and are defined by shallow angles relative to the flat surfaces.

16. A combination as set forth in claim 15 wherein the shallow angle is between approximately three degrees (3°) and nine degrees (9°).

17. In combination for use against a workpiece, a disc having first and second spaced surfaces, there being abrasive particles on at least the first surface of the disc, there being a central bore in the disc, a nut disposed against the first surface of the disc and the wall of the bore of the disc, the nut having an internally threaded bore, an adhesive material bonding the nut to the wall of the bore of the abrasive disc and the first surface of the abrasive disc, an arbor externally threaded to receive the internally threaded bore in the nut, the adhesive material having elastomeric properties to compensate for any changes in the positioning of the arbor, a camming member disposed on the arbor and having a first face and having at least one inclined surface on the first face of the camming member, and a reinforcing plate disposed on the arbor for axial movement along the arbor and having first and second opposite faces and having at least one inclined surface on the first face for engagement with the at least one inclined surface on the first face of the camming member to produce a movement of the reinforcing plate toward the disc when the disc is applied against the workpiece.

18. A combination as set forth in claim 17, including, means on at least one of the second surfaces of the disc and the reinforcing plate for providing a yieldably clutching relationship between the disc and the reinforcing plate.

19. A combination as set forth in claim 17, including, means on at least one of the camming member and the reinforcing plate for limiting the axial movement of the reinforcing plate on the arbor toward the disc.

20. A combination as set forth in claim 17 wherein the inclined surfaces on the reinforcing plate and the camming member are uniformly inclined and are smooth.

21. A combination as set forth in claim 20 wherein flat surfaces are provided on the reinforcing plate and the camming member as a continuation of the inclined surfaces on the camming member and the reinforcing plate and the lengths of the flat surfaces are greater than the lengths of the inclined surfaces.

22. A combination as set forth in claim 21 wherein the angles of the inclined surfaces on the camming member and the reinforcing plate relative to the flat surfaces on the camming member and the reinforcing plate are relatively shallow.

23. A combination as set forth in claim 17 wherein a spring is disposed between the camming member and the reinforcing plate and is constrained in the coupled relationship between the reinforcing plate and the disc to provide for a movement of the reinforcing plate from the disc when the disc becomes decoupled from the reinforcing plate.

24. An abrasive article for use with apparatus for holding and rotating the abrasive article for application against a workpiece where the apparatus includes a threaded arbor and a reinforcing plate disposed relative to the arbor for rotation in a particular direction relative to the arbor and having a yieldable clutching member, including, a disc made from a stiff member and having first and second opposite faces, abrasive particles disposed on at least the first face of the disc for providing an abrading action against the workpiece, a projection extending from the second surface of the disc for cooperating with the yieldable clutching member on the reinforcing plate to act as a clutch for driving the disc with the reinforcing plate, the projection being provided in an exposed relationship with respect to the yieldable clutching member, there being a bore in the center of the disc, a nut disposed in the bore in the disc in abutting relationship to the bore and to the first face of the disc, the nut being internally bored and threaded to fit on the threaded arbor, and an adhesive material attaching the nut to the walls of the bore and to the first face of the disc and having elastomeric properties to compensate for deviations in the positioning of the arbor.

25. An abrasive article as set forth in claim 24 wherein the disc is internally depressed at the center of the disc and the projection is annular and is concentric with the disc and wherein the projection is integral with the disc.

26. An abrasive article as set forth in claim 25 wherein the disc is made from a phenolic resin.

27. An abrasive article as set forth in claim 24 wherein the nut abuts the disc only in the bore and at the first face of the disc.

28. An abrasive article as set forth in claim 24 wherein the nut is disposed in abutting and adhering relationship only with the central bore of the disc and the portion of the first surface of the disc adjacent the central bore.

29. An abrasive article for use with apparatus for holding and rotating the abrasive article for application against a workpiece where the apparatus includes a threaded arbor and a reinforcing plate supported by the arbor and disposed relative to the arbor for rotation in a first direction relative to the arbor and having a yieldable clutching member, including, a disc made from a stiff material and provided with a central bore and first and second opposite faces, there being abrasive particles attached to the first face of the disc, means extending from the second surface of the disc for cooperating with the yieldable clutching member on the reinforcing plate to act as a clutch for driving the disc with the reinforcing plate, said means being provided in an exposed reationship with respect to the yieldable clutching member, a nut disposed in the bore in the disc and internally threaded for rotation on the arbor in a second direction opposite to the first direction to engage the reinforcing plate and produce a rotation on the reinforcing plate relative to the arbor in the first direction in accordance with the rotation of the disc relative to the arbor in the second direction, and adhesive material disposed between the nut and the disc and yieldably adhering the nut to the disc, the adhesive material having elastomeric properties.

30. An abrasive article as set forth in claim 29 wherein the bore is depressed at the center of the disc and the cooperating means on the second surface of the disc is annular and is concentric with the disc and wherein the engaging means is integral with the disc.

31. An abrasive article as set forth in claim 29 wherein the means on the second surface of the disc for cooperating with the yieldable clutching member on the reinforcing plate constitutes a projection.

32. An abrasive article as set forth in claim 31 wherein the projection has an annular configuration and is disposed between the central bore and the periphery of the disc and is integral with the disc.

33. An abrasive article as set forth in claim 30 wherein the nut in the central bore of the disc terminates at a position which prevents such means from extending beyond the second surface of the disc.

34. An abrasive article as set forth in claim 33, including, the means disposed on the second surface of the disc for cooperating with the reinforcing plate has a pyramidal configuration in section.

35. An abrasive article as set forth in claim 34 wherein the cooperating means is spaced from the central bore of the disc and is provided with an annular configuration and wherein the cooperating means defines a yieldable clutch arrangement with the yieldable clutching member on the reinforcing plate.

36. An abrasive article as set forth in claim 35 wherein the cooperating means constitutes an annular projection from the second surface of the disc.

37. An abrasive article as set forth in claim 32 wherein the elastomeric material constitutes silicone rubber.

38. An abrasive article for use with apparatus for holding and rotating the abrasive article for application against a workpiece where the apparatus includes a threaded arbor and a reinforcing plate supported by the arbor and disposed relative to the arbor for rotation in a first direction relative to the arbor and having a yieldable clutching member, including:

a disc made from a stiff material and provided with a central bore and with first and second spaced and substantially parallel surfaces, abrasive particles attached to at least the first surface of the disc, means extending from the second surface of the disc in an exposed relationship with respect to the yieldable clutching member for cooperating with the yieldable clutching member on the reinforcing plate to act as a clutch for driving the disc with the reinforcing plate, means disposed in the central bore of the disc and disposed in abutting relationship only to the walls of the central bore and to the portion of the first surface of the disc adjacent the central bore and provided with a threaded central bore for rotation on the arbor in a second direction opposite to the first direction, the disc being constructed to produce an engagement between the cooperating means on the second surface of the disc and the yieldable clutching member on the reinforcing plate and then to provide a rotation of the reinforcing plate in the first direction with a rotation of the disc in the second direction, and an elastomeric material binding the nut to the walls of the central bore of the disc and to the first surface of the disc in a yieldable relationship.

39. An abrasive article as set forth in claim 38, including, the means disposed on the second surface of the disc for engaging the yieldable clutching member on the reinforcing plate constituting a projection.

40. In combination for use with a rotatable arbor and a camming member on the arbor, a reinforcing plate having a first and second surfaces and having a yieldable clutching member on one surface and having at least one inclined surface on the second surface, a disc having first and second surfaces and having abrasive particles on the first surface and having means on the second surface for engaging the yieldable clutching member, the reinforcing plate and the disc being constructed to provide a firm engagement between the yieldable clutch member and the engaging means upon an initial engagement between the yieldable clutching member and the engaging means and upon a rotation of the arbor and the camming member.

41. In a combination as set forth in claim 40, the engaging means constituting a projection on the second surface of the disc.

42. In a combination as set forth in claim 41, the projection on the second surface of the disc being annular and concentric with the disc and the yieldable clutching member being annular and being positioned to engage the annular projection on the second surface of the disc.

43. In a combination as set forth in claim 40, the engaging means on the disc being exposed relative to the yieldable clutching member on the reinforcing plate to cooperate with the yieldable clutching member in acting as a clutch for driving the disc with the reinforcing plate upon a rotation of the arbor and the camming member.

* * * * *